US008831501B2

(12) United States Patent
Vella et al.

(10) Patent No.: US 8,831,501 B2
(45) Date of Patent: Sep. 9, 2014

(54) DELIVERY MEMBER FOR USE IN AN IMAGE FORMING APPARATUS

(75) Inventors: Sarah J. Vella, Milton (CA); Nan-Xing Hu, Oakville (CA); Yu Liu, Mississauga (CA); Richard A. Klenkler, Oakville (CA)

(73) Assignee: Xerox Corporation, Norwalk, CT (US)

( * ) Notice: Subject to any disclaimer, the term of this patent is extended or adjusted under 35 U.S.C. 154(b) by 302 days.

(21) Appl. No.: 13/426,836

(22) Filed: Mar. 22, 2012

(65) Prior Publication Data

US 2013/0251432 A1 Sep. 26, 2013

(51) Int. Cl.
*G03G 21/00* (2006.01)

(52) U.S. Cl.
CPC ..... *G03G 21/0094* (2013.01)
USPC ..... 399/346

(58) Field of Classification Search
CPC ..... G03G 21/0094; G03G 2221/1609
USPC ..... 399/159, 176, 346
See application file for complete search history.

(56) References Cited

U.S. PATENT DOCUMENTS

| | | | |
|---|---|---|---|
| 3,121,006 | A | 2/1964 | Middleton et al. |
| 4,387,980 | A | 6/1983 | Ueno et al. |
| 4,435,074 | A | 3/1984 | Midorikawa et al. |
| 4,464,450 | A | 8/1984 | Teuscher |
| 4,587,189 | A | 5/1986 | Hor et al. |
| 4,664,995 | A | 5/1987 | Horgan et al. |
| 4,921,773 | A | 5/1990 | Melnyk et al. |
| 5,069,993 | A | 12/1991 | Robinette et al. |
| 5,384,929 | A | 1/1995 | Smith |
| 5,499,089 | A | 3/1996 | Tsukamoto et al. |
| 5,646,718 | A | 7/1997 | Suwa et al. |
| 5,756,245 | A | 5/1998 | Esteghamatian et al. |
| 6,434,357 | B1 | 8/2002 | Maul et al. |
| 6,582,222 | B1 | 6/2003 | Chen et al. |
| 6,869,918 | B2 | 3/2005 | Cornelius |
| 7,428,402 | B2 | 9/2008 | Hays et al. |
| 7,526,243 | B2 | 4/2009 | Zaman et al. |
| 7,580,655 | B2 | 8/2009 | Nukada et al. |
| 7,725,069 | B2 | 5/2010 | Kawahara et al. |
| 7,734,242 | B2 | 6/2010 | Hatakeyama et al. |
| 7,877,054 | B1 | 1/2011 | Thayer et al. |
| 7,881,651 | B2 | 2/2011 | Watanabe |
| 7,960,082 | B2 | 6/2011 | Aziz et al. |
| 8,600,281 | B2 * | 12/2013 | Hu et al. ..... 399/346 |
| 2003/0049555 | A1 | 3/2003 | Sakon et al. |
| 2003/0118372 | A1 | 6/2003 | Kitano et al. |
| 2005/0163527 | A1 | 7/2005 | Tombs |

(Continued)

FOREIGN PATENT DOCUMENTS

| | | | |
|---|---|---|---|
| JP | 2002357983 | A | 12/2002 |

OTHER PUBLICATIONS

Sanghera, U.S. Appl. No. 13/354,022, Office Action dated Aug. 8, 2013, 25 pages.

(Continued)

*Primary Examiner* — William J Royer
(74) *Attorney, Agent, or Firm* — Hoffman Warnick LLC

(57) ABSTRACT

There is described a delivery member for use in an image forming apparatus. The delivery member includes a support member and a first layer including an elastomeric matrix, a porous material and a functional material dispersed therein. The first layer is disposed on the support member.

20 Claims, 8 Drawing Sheets

(56) References Cited

U.S. PATENT DOCUMENTS

| | | | |
|---|---|---|---|
| 2009/0087213 | A1 | 4/2009 | Takaya et al. |
| 2009/0162092 | A1 | 6/2009 | Hoshio |
| 2009/0185821 | A1 | 7/2009 | Iwamoto et al. |
| 2009/0220876 | A1 | 9/2009 | De Jong et al. |
| 2010/0189461 | A1 | 7/2010 | Shintani et al. |
| 2011/0033798 | A1 | 2/2011 | Kim et al. |
| 2011/0206430 | A1 | 8/2011 | Arai et al. |

OTHER PUBLICATIONS

Walsh, U.S. Appl. No. 13/279,981, Office Action dated Nov. 6, 2013, 20 pages.

U.S. Appl. No. 13/192,252, filed Jul. 27, 2011.

U.S. Appl. No. 13/192,215, filed Jul. 27, 2011.

U.S. Appl. No. 13/020,738, filed Feb. 3, 2011.

U.S. Appl. No. 12/845,662, filed Jul. 28, 2010.

U.S. Appl. No. 13/286,905, filed Nov. 1, 2011.

U.S. Appl. No. 13/533,475, Notice of Allowance and Fees Due, Dec. 9, 2013, 20 pages.

U.S. Appl. No. 13/437,472, Office Action, Dec. 20, 2013, 18 pages.

U.S. Appl. No. 13/437,472, Notice of Allowance & Fees Due, Mar. 31, 2014, 7 pages.

U.S. Appl. No. 13/326,414, Office Action, Mar. 28, 2014, 19 pages.

* cited by examiner

DELIVERY MEMBER FOR USE IN AN IMAGE FORMING APPARATUS

BACKGROUND

1. Field of Use

This disclosure is generally directed to the delivery of a functional material or lubricant to the surface of imaging members, photoreceptors, photoconductors, and the like.

2. Background

In electrophotography or electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on image areas by the electrostatic charge on the surface of the photoreceptor. Thus, a toner image is produced in conformity with a light image of the original image being reproduced or printed. The toner image may then be transferred to a substrate or support member (e.g., paper) directly or through the use of an intermediate transfer member, and the toner image affixed thereto to form a permanent record of the original image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor (image bearing member), a contact type charging device has been used, such as disclosed in U.S. Pat. Nos. 4,387,980 and 7,580,655, which are incorporated herein by reference in their entirety. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The outer surface of the image bearing member is charged at a contact area. The contact type charging device charges the image bearing member to a predetermined potential.

Electrophotographic photoreceptors can be provided in a number of forms. For example, the photoreceptors can be a homogeneous layer of a single material, such as vitreous selenium, or the photoreceptor can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "holeblocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

To further increase the service life of the photoreceptor, use of overcoat layers (overcoats) has also been implemented to protect photoreceptors and improve performance, such as wear resistance. However, these low wear overcoats are associated with poor image quality due to A-zone deletion in a humid environment as the wear rates decrease to a certain level. In addition, high torque associated with low wear overcoats in A-zone also causes severe issues with BCR charging systems, such as motor failure and blade damage. As a result, use of a low wear overcoat with BCR charging systems is still a challenge, and there is a need to find ways to increase the life of the photoreceptor.

SUMMARY

Disclosed herein is a delivery member for use in an image forming apparatus. The delivery member includes a support member and a first layer comprising an elastomeric matrix, a porous material and a functional material dispersed therein. The first layer is disposed on the support member.

Disclosed herein is a delivery member for use in an image forming apparatus. The delivery member includes a support member and an inner layer disposed on the support member. The inner layer comprises an elastomeric matrix, aerogel particles and paraffin. The inner layer comprises a weight ratio of elastomeric matrix to aerogel particles and paraffin of from about 20:1 to about 1:5. An outer layer is disposed on the inner layer and the outer layer comprises pores having a size of less than about 1 μm. The outer layer comprises a thickness of from about 0.1 μm to about 1 mm.

Disclosed herein is an image forming apparatus comprising an imaging member having a charge retentive surface for developing an electrostatic latent image thereon. The imaging member comprises a substrate and a photoconductive member disposed on the substrate. The image forming apparatus includes a charging unit for applying an electrostatic charge on the imaging member to a predetermined electric potential. The image forming apparatus includes a delivery member disposed in contact with the surface of the imaging member or a surface of the charging unit. The delivery member comprises a support member and an inner layer disposed on the support member. The inner layer comprises an elastomeric matrix, aerogel particles and a functional material dispersed therein. The delivery member includes an outer layer disposed on the inner layer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
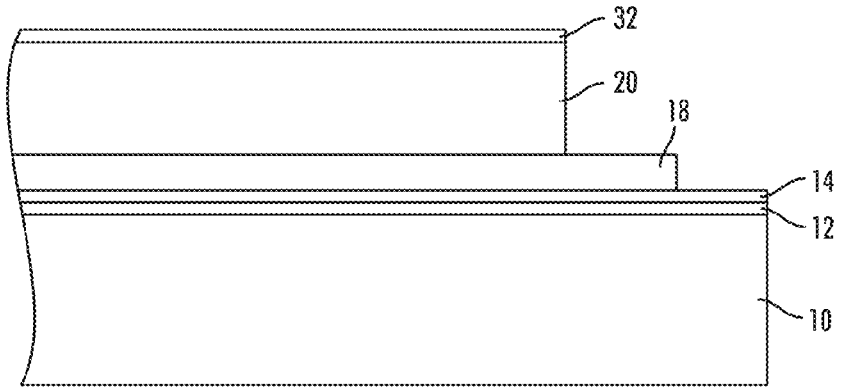
FIG. 1 is a cross-sectional view of an imaging member in a drum configuration according to the present embodiments.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The disclosed embodiments are directed generally to delivery apparatus for applying a layer of a functional material that acts as a lubricant on an imaging member surface. The layer of functional material acts as a barrier against moisture and/or surface contaminants thereby protecting the surface of the imaging member. The apparatus provides improved wear resistance, low friction, and reduced image defects due to deletion in high humidity conditions which leads to improved xerographic performance in imaging members.

A long life photoreceptor (P/R) enables significant cost reduction. Generally P/R life extension is achieved with a wear-resistant overcoat. However, wear resistant overcoats are associated with an increase in A-zone deletion (a printing defect that occurs at high humidity). Most organic photoreceptor materials require a minimal wear rate of 2 nm/Kcycle (Scorotron charging system) or from about 5 nm/Kcycle to about 10 nm/Kcycle (BCR charging system) in order to suppress A-zone deletion. In addition, wear-resistant overcoats cause a higher torque that results in issues with BCR (bias charging roller) charging systems, such as motor failure and blade damage (which results in streaking of toner in prints).

FIG. 1 is an exemplary embodiment of a multilayered electrophotographic imaging member or photoreceptor having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer 20 may also be included. The substrate 10 may be a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate 10 may also comprise a material selected from the group consisting of a metal, a polymer, a glass, a ceramic, and wood.

The charge generation layer 18 and the charge transport layer 20 form an imaging layer described here as two separate layers. In an alternative to what is shown in the figure, the charge generation layer 18 may also be disposed on top of the charge transport layer 20. It will be appreciated that the functional components of these layers may alternatively be combined into a single layer.

Figure 2:
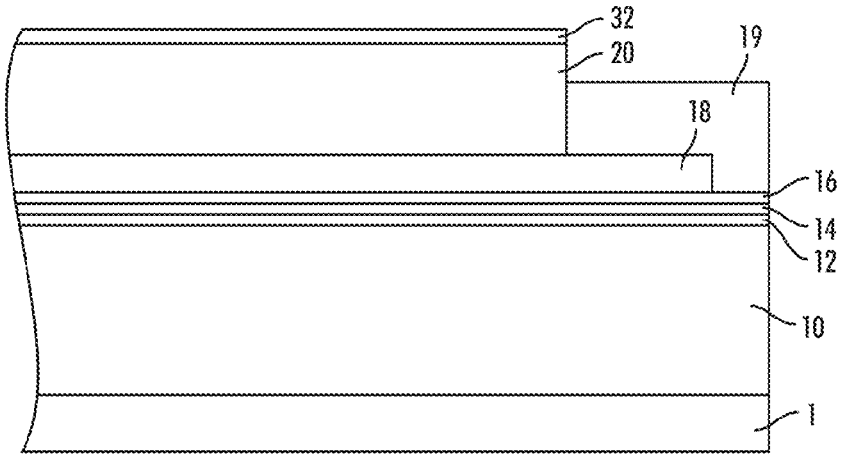
FIG. 2 is a cross-sectional view of an imaging member in a belt configuration according to the present embodiments.

FIG. 2 shows an imaging member or photoreceptor having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference in its entirety.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include an anti-curl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Common print quality issues are strongly dependent on the quality and interaction of these photoreceptor layers. For example, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a cleaning step. Still further, repetitive cycling causes the outermost layer of the photoreceptor to experience a high degree of frictional contact with other machine subsystem components used to clean and/or prepare the photoreceptor for imaging during each cycle. When repeatedly subjected to cyclic mechanical interactions against the machine subsystem components, a photoreceptor can experience severe frictional wear at the outermost organic photoreceptor layer surface that can greatly reduce the useful life of the photoreceptor. Ultimately, the resulting wear impairs photoreceptor performance and thus image quality. Another type of common image defect is thought to result from the accumulation of charge somewhere in the photoreceptor. Consequently, when a sequential image is printed, the accumulated charge results in image density changes in the current printed image that reveals the previously printed image. In the xerographic process spatially varying amounts of positive charges from a transfer station find themselves on the photoreceptor surface. If this variation is large enough it will manifest itself as a variation in the image potential in the following xerographic cycle and print out as a defect.

A conventional approach to photoreceptor life extension is to apply an overcoat layer with wear resistance. For bias charge roller (BCR) charging systems, overcoat layers are associated with a trade-off between A-zone deletion (i.e. an image defect occurring in A-zone: 28° C., 85% RH) and photoreceptor wear rate. For example, most organic photoconductor (OPC) materials sets require a certain level of wear rate in order to suppress A-zone deletion, thus limiting the life of a photoreceptor. The present embodiments, however, have demonstrated a decrease in wear rate of a photoreceptor while maintaining the image quality of the photoreceptor, such as decreased image deletions. The present embodiments provide photoreceptor technology for BCR charging systems with a significantly expanded life.

Disclosed herein is a delivery device (delivery apparatus; delivery member; delivery roller) and system that provide better delivery of a functional material or lubricant to the surface of the imaging member, typically a photoreceptor. The delivery roller comprises a layer that functions as a reservoir for the functional material and controls delivery of the functional material. In embodiments, the delivery device includes an outer layer that functions to control the delivery of the functional material.

In an embodiment there is provided a delivery roller having a layer comprising an elastomeric matrix and a porous material and functional material dispersed in the elastomeric matrix. In an embodiment the layer containing the porous material and functional material dispersed in the elastomeric matrix is overcoated with an outer layer comprising an elastomer. The outer layer has pores less than about 1 μm, or less than about 500 nm or less than about 300 nm. The porous material has a porosity of from about 50 percent to about 99.9 percent. The porous material functions as a reservoir to store the functional material. The pores of the porous material are from about 2 nm up to about 50 microns, or the pores are from about 10 nm microns to about 20 microns, or the pores are from about 100nm to about 17 microns. The pores of the porous material are filled with functional material. When an outer layer is provided in a delivery roller, the outer layer can help control the diffusion of the functional material from the inner layer. The delivery roller applies an ultra-thin film of functional material to the surface of a photoreceptor either directly or indirectly which: i) reduces torque between the P/R and a cleaning blade and ii) eliminates A-zone deletions, both of which improve image quality.

The incorporation of a solid, porous material, for example silica aerogel, increases the amount of functional material (particularly one that is incompatible with the elastomeric matrix) stored in the delivery roller. Paraffin oil and PDMS are immiscible, which limits the quantity of paraffin oil that can be dispersed in a PDMS matrix to about 33 weight percent of the layer. Silica aerogels, which can have porosities up to 99.9 percent, absorb paraffin oil and stabilize its dispersion in the elastomeric matrix. The delivery roller described herein provides a way to store larger quantities of functional material in the delivery roller and increase its overall lifetime.

The present embodiments employ a delivery apparatus and system to deliver a layer of functional materials onto the photoreceptor surface either directly or through a charging roller. The functional material is applied to the photoreceptor surface and acts as lubricant and/or a barrier against moisture and surface contaminants and improves xerographic performance in high humidity conditions, such as, for example, A-zone environment. The ultra-thin layer may be provided on a nano-scale or molecular level.

In embodiments, a functional material is continuously delivered on the photoreceptor to form an ultra-thin layer of lubricant to protect machine subsystem components through reducing friction between the cleaning blade and the photoreceptor surface or at the contact interface between the photoreceptor surface and other relevant components. This lubricant further reduces the resultant torque and vibration so that the actuator and involved transmission mechanisms can move the photoreceptor or other relevant components in a smoother way. Therefore, the lubricant improves the printed image quality, which may be deteriorated due to aforementioned reasons, and further protects these components and extends their service life.

In embodiments, there is provided an image forming apparatus that includes a delivery member for delivering functional materials onto a photoreceptor. The image forming apparatus typically comprises an imaging member; a charging unit comprising a charging roller disposed in contact with the surface of the imaging member; and a delivery unit disposed in contact with the surface of the charging roller, wherein the delivery unit applies a layer of functional material to the surface of the charging roller and the charging roller in turn applies a layer of the functional material onto the surface of the imaging member. In an embodiment, the delivery roller delivers a functional material directly to the surface of the imaging member.

Figure 3:
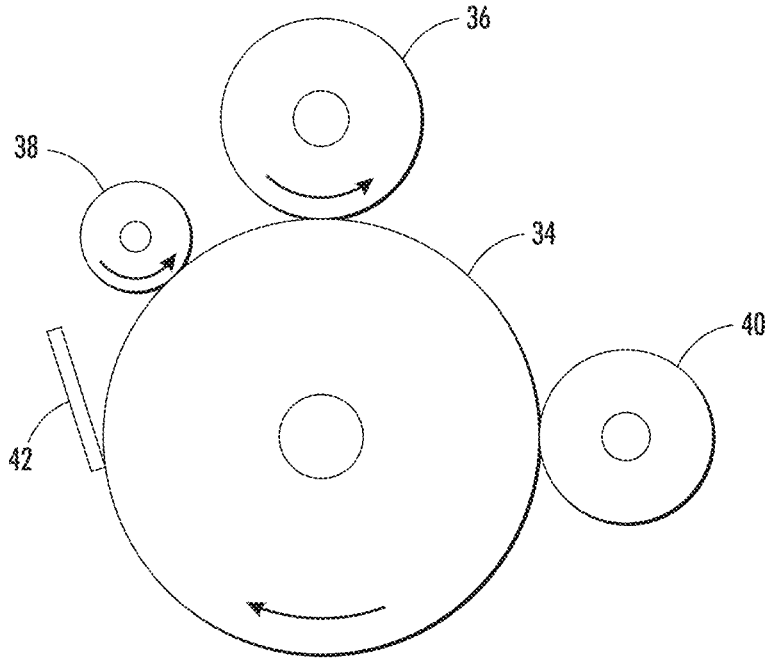
FIG. 3 is a cross-sectional view of a system implementing a delivery member according to the present embodiments.

In FIG. 3, there is illustrated an image-forming apparatus in a BCR charging system. As shown, the image-forming apparatus comprises a photoreceptor 34, a BCR 36 and a delivery member 38. The delivery member 38 contacts the photoreceptor 34 to deliver an ultra-thin layer of a functional material onto the surface of the photoreceptor 34. Subsequently, the photoreceptor 34 is substantially uniformly charged by the BCR 36 to initiate the electrophotographic reproduction process. The charged photoreceptor 34 is then exposed to a light image (not shown) to create an electrostatic latent image on the photoreceptor 34. This latent image is subsequently developed into a visible image by a toner developer 40. Thereafter, the developed toner image is transferred from the photoreceptor 34 through a record medium to a copy sheet or some other image support substrate to which the image may be permanently affixed for producing a reproduction of the original document (not shown). The photoreceptor surface is generally then cleaned with a cleaner 42 to remove any residual developing material therefrom, in preparation for successive imaging cycles.

Figure 4:
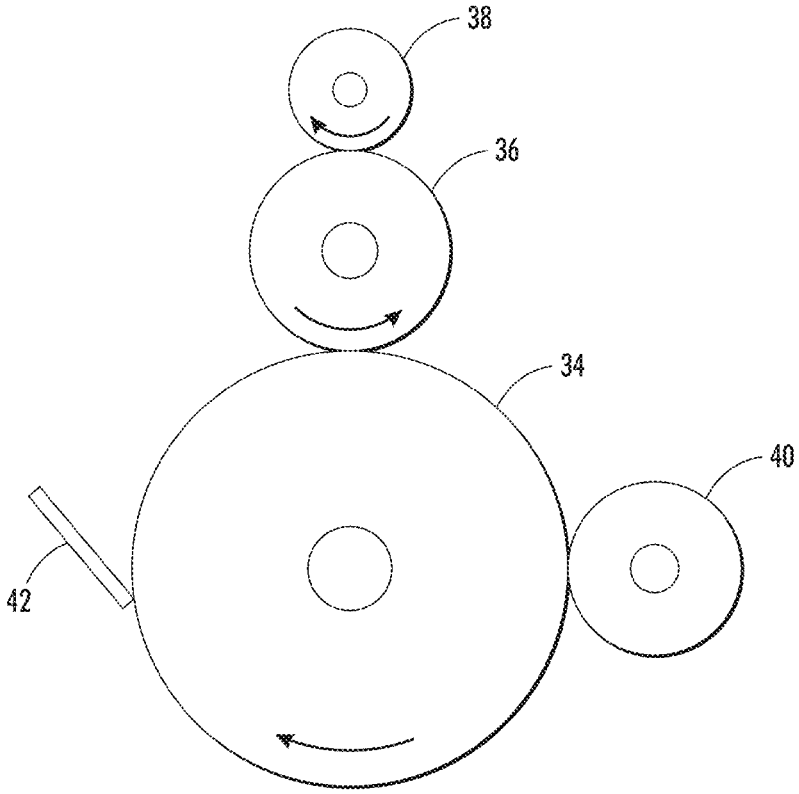
FIG. 4 is an alternative cross-sectional view of a system implementing a delivery member according to the present embodiments.

In FIG. 4, there is illustrated an alternate embodiment image-forming apparatus in a BCR charging system. As shown, the image-forming apparatus comprises a photoreceptor34, a BCR 36 and a delivery member 38. The delivery member 38 contacts the BCR 36 which in turn contacts the photoreceptor 34 to deliver an ultra-thin layer of a functional material onto the surface of the photoreceptor 34. The photoreceptor 34 is substantially uniformly charged by the BCR 36 to initiate the electrophotographic reproduction process. The charged photoreceptor 34 is then exposed to a light image (not shown) to create an electrostatic latent image on the photoreceptor 34. This latent image is subsequently developed into a visible image by a toner developer 40. Thereafter, the developed toner image is transferred from the photoreceptor 34 through a record medium to a copy sheet or some other image support substrate to which the image may be permanently affixed for producing a reproduction of the original document (not shown). The photoreceptor surface is generally then cleaned with a cleaner 42 to remove any residual developing material therefrom, in preparation for successive imaging cycles.

Figure 5:
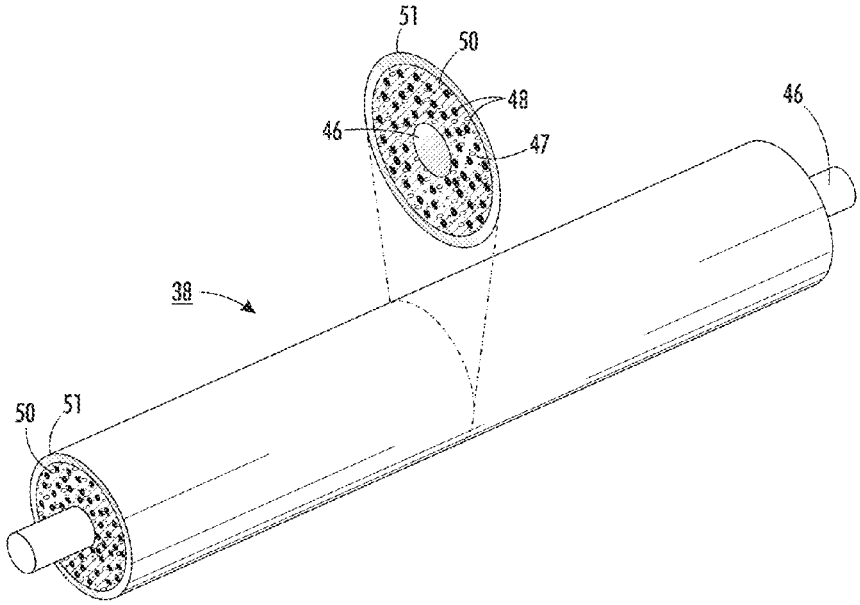
FIG. 5 depicts a side view and cross-sectional view of a delivery member according to the present embodiments.

FIG. 5 illustrates a delivery member 38 according to various embodiments. The delivery member 38 comprises a dual layer comprising an inner layer 50 and an outer layer 51. The inner layer 50 comprises an elastomeric matrix 47 having a porous material 48 dispersed throughout. The porous material 48 serves as a reservoir to store a functional material. The inner layer 50 is disposed around a support member 46. The outer layer 51 is disposed over the inner layer 50. The outer layer 51 is an elastomeric material that contains pores having a size less than 1 μm.

Figure 6:
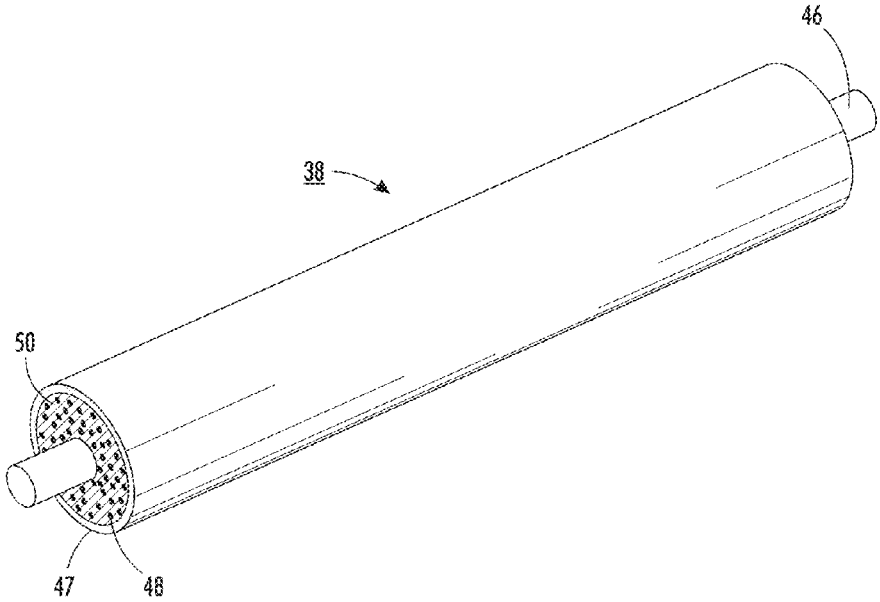
FIG. 6 is a side view of a delivery member according to the present embodiments.

FIG. 6 illustrates a delivery member 38 according to various embodiments. The delivery member 38 comprises a single layer comprising a first layer 50. The first layer 50 comprises an elastomeric matrix 47 having a porous material 48 dispersed throughout. The porous material 48 serves as a reservoir to store a functional material. The first layer 50 is disposed around a support member 46.

In embodiments, the support member 46 is a stainless steel rod. The support member 46 can further comprise a material selected from the group consisting of metal, metal alloy, plastic, ceramic, and glass, and mixtures thereof.

The diameter of the support member 46 and the thickness of the inner layer 50 may be varied depending on the application needs. In specific embodiments, the support member 46 has a diameter of from about 3 mm to about 10 mm. In specific embodiments, the inner layer 50 has a thickness of from about 20 μm to about 100 mm.

In the present embodiments, the functional material contained with porous material 48 of the inner layer 50 is delivered to the surface of the outer layer 51 (FIG. 5) or the functional material is delivered directly to the surface of inner layer 50 (FIG. 6). The functional material is transferred to the surface of the imaging member directly (FIG. 3) or indirectly through transfer to the BCR surface (FIG. 4). Delivery members fabricated according to the present embodiments have been shown to contain sufficient quantities of the functional material to continuously supply an ultra-thin layer of the functional material to the surface of the BCR/photoreceptor.

In embodiments, the functional material can be an organic or inorganic compound, oligomer or polymer, or a mixture thereof. The functional materials may be in the form of liquid, wax, or gel, and a mixture thereof. The functional material may also be selected from the group consisting of a lubricant material, a hydrophobic material, an oleophobic material, an amphiphilic material, and mixtures thereof. Illustrative examples of functional materials may include, for example, a liquid material selected from the group consisting of hydrocarbons, fluorocarbons, mineral oil, synthetic oil, natural oil, and mixtures thereof. The functional materials may further contain a functional group that facilitates adsorption of the functional materials on the photoreceptor surface, and optionally a reactive group that can chemically modify the photoreceptor surface. For examples, the functional materials may comprise paraffinic compound, alkanes, fluoroalkanes, alkyl silanes, fluoroalkyl silanes alkoxy-silanes, siloxanes, glycols or polyglycols, mineral oil, synthetic oil, natural oil or mixture thereof.

In embodiments, the inner layer 50 in FIG. 5, or the first layer 50 in FIG. 6 may be comprised of a polymer selected from the group consisting of polysiloxanes, polyurethanes, polyesters, fluoro-silicones, polyolefin, fluoroelastomers, synthetic rubber, natural rubber, and mixtures thereof.

The porous material 48 is selected from the group consisting of aerogel particles, ceramic particles, polymers, foam, cellulose and glass. The porosity of the porous material 48 is from about 50 percent to about 99.9 percent. In embodiments the porosity of the porous material 48 is from about 60 percent to about 99 percent, or from about 65 percent to about 95 percent. The porous material 48 and functional material comprise about 50 weight percent to about 90 weight percent of the first layer or inner layer 50. In embodiment embodiments, the porous material 48 and functional material comprise about 55 weight percent to about 85 weight percent of the first layer or inner layer 50, or the porous material 48 and functional material comprise about 60 weight percent to about 80 weight percent of the first layer or inner layer 50.

The nominal torque between a standard photoreceptor drum (i.e. a drum without an overcoat layer) and a BCR is approximately 0.8 Nm. The torque between an overcoated photoreceptor drum and a BCR is well over 1 Nm; this amount of torque causes damage to the photoreceptor cleaning blade which becomes ineffective for preventing contamination of other components, such as the BCR. Ineffective removal of toner and additives by the cleaning blade leads to poor image quality in prints. The introduction of the delivery roller device into the system that delivers an ultra-thin layer of functional material to the surface of the photoreceptor decreases the torque between the photoreceptor and BCR to ~0.65 Nm, which is lower than the torque with a standard drum.

Aerogels may be described, in general terms, as gels that have been dried to a solid phase by removing pore fluid and replacing the pore fluid with air. As used herein, an "aerogel" refers to a material that is generally a very low density ceramic solid, typically formed from a gel. The term "aerogel" is thus used to indicate gels that have been dried so that the gel shrinks little during drying, preserving its porosity and related characteristics. In contrast, "hydrogel" is used to describe wet gels in which pore fluids are aqueous fluids. The term "pore fluid" describes fluid contained within pore structures during formation of the pore element(s). Upon drying, such as by supercritical drying, aerogel particles are formed that contain a significant amount of air, resulting in a low density solid and a high surface area. In various embodiments, aerogels are thus low-density microcellular materials characterized by low mass densities, large specific surface areas and very high porosities. In particular, aerogels are characterized by their unique structures that comprise a large number of small inter-connected pores. After the solvent is removed, the polymerized material is pyrolyzed in an inert atmosphere to form the aerogel.

Any suitable aerogel component can be used. In embodiments, the aerogel component can be, for example, selected from inorganic aerogels, organic aerogels, carbon aerogels, and mixtures thereof. In particular embodiments, ceramic aerogels can be suitably used. These aerogels are typically composed of silica, but may also be composed of metal oxides, such as alumina, titania and zirconia, or carbon, and can optionally be doped with other elements such as a metal. In some embodiments, the aerogel component can comprise aerogels chosen from polymeric aerogels, colloidal aerogels, and mixtures thereof.

Aerogel particles of embodiments may have porosities of from about 50 percent to about 99.9 percent, in which the aerogel can contain 99.9 percent empty space. In embodiments the aerogel particles have porosities of from about 50 percent to about 99.0 percent, or from 50 percent to about 98 percent. In embodiments, the pores of aerogel components may have diameters of from about 2 nm to about 500 nm, or from about 10 nm to about 400 nm or from about 20 nm to about 100 nm. In particular embodiments, aerogel components may have porosities of more than 50% pores with diameters of less than 100 nm and even less than about 20 nm. In embodiments, the aerogel components may be in the form of particles having a shape that is spherical, or near-spherical, cylindrical, rod-like, bead-like, cubic, platelet-like, and the like.

In embodiments, the aerogel components include aerogel particles, powders, or dispersions ranging in average volume particle size of from about 1 μm to about 100 μm, or about 3 μm to about 50 μm, or about 5 μm to 20 μm. The aerogel components can include aerogel particles that appear as well dispersed single particles or as agglomerates of more than one particle or groups of particles within the polymer material.

Generally, the type, porosity, pore size, and amount of aerogel used for a particular embodiment may be chosen based upon the desired properties of the resultant composition and upon the properties of the polymers and solutions thereof into which the aerogel is being combined. For example, if a pre-polymer (such as a low molecular weight polyurethane monomer that has a relatively low process viscosity, for example less than 10 centistokes) is chosen for use in an embodiment, then a high porosity, for example greater than 80%, and high specific surface area, for example greater than about 500 $m^2/\mu m$, aerogel having relatively small pore size, for example less than about 100 nm, may be mixed at relatively high concentrations, for example greater than about 2 weight percent to about 20 weight percent, into the pre-polymer by use of moderate-to-high energy mixing techniques, for example by controlled temperature, high shear and/or blending. If a hydrophobic-type aerogel is used, upon cross-linking and curing/post curing the pre-polymer to form an infinitely long matrix of polymer and aerogel filler, the resultant composite may exhibit improved hydrophobicity and increased hardness when compared to a similarly prepared sample of unfilled polymer. The improved hydrophobicity may be derived from the polymer and aerogel interacting during the liquid-phase processing whereby a portion of the molecular chain of the polymer interpenetrates into the pores of the aerogel and the non-pore regions of the aerogel serves to occupy some or all of the intermolecular space where water molecules could otherwise enter and occupy.

Aerogels that can suitably be used in embodiments may be divided into four major categories: inorganic aerogels, metal oxide aerogels, organic aerogels and carbon aerogels.

Inorganic aerogels, such as silica aerogels, are generally formed by sol-gel polycondensation of metal oxides to form highly cross-linked, transparent hydrogels. These hydrogels are subjected to supercritical drying to form inorganic aerogels.

Organic aerogels are generally formed by sol-gel polycondensation of resorcinol and formaldehyde. These hydrogels are subjected to supercritical drying to form organic aerogels.

Carbon aerogels are generally formed by pyrolyzing organic aerogels in an inert atmosphere. Carbon aerogels are composed of covalently bonded, nanometer-sized particles that are arranged in a three-dimensional network. Carbon aerogels, unlike high surface area carbon powders, have oxygen-free surfaces, which can be chemically modified to increase their compatibility with polymer matrices.

For example, in one embodiment, the aerogel particles can be a silica silicate having an average particle size of 5-15 microns, a porosity of 90% or more, a bulk density of 40-100 $kg/m^3$, and a surface area of 600-800 $m^2/g$. Of course, materials having one or properties outside of these ranges can be used, as desired.

In general, a wide range of aerogel components are known in the art and have been applied in a variety of uses. One specific non-limiting example is the commercially available powder that has already been chemically treated, Dow Corning VM-2270 Aerogel fine particles having a size of about 5-15 microns.

In embodiments, the inner layer 50 in FIG. 5, or first layer 50 in FIG. 6 contains an elastomeric matrix comprised of a polymer selected from the group consisting of polysiloxane such as polydialkyl siloxane, wherein said alkyl has from about 1 to about 10 carbons, such as methyl, ethyl, propyl and the like, silicones, polyurethane, polyester, fluoro-silicone, polyolefin, fluoroelastomer, synthetic rubber, natural rubber and mixtures thereof. In embodiments, the matrix comprises polydimethylsiloxane (PDMS).

In embodiments, the inner layer 50 in FIG. 5, or first layer 50 in FIG. 6 is an elastomeric material mixed with the functional material absorbed into the porous material 48 and cast around the support member 46 by use of a mold. Thereafter, the elastomeric matrix 47 is cured. After curing, the elastomeric matrix 47 containing the porous material 48 and functional material is extracted from the mold. In embodiments, an outer layer 51 is prepared by mixing a cross-linkable eleastomeric polymer and then casting the mixture onto the inner layer 50 by use of a mold. The elastomeric material is then cured to form the delivery member 38.

In a specific embodiment, the inner layer or first layer 50 is a paraffin-impregnated silicone cast around the support member 46 that includes the porous material 48. The inner layer 50 of paraffin-impregnated silicone is prepared by absorbing paraffin into the porous material 48, such as aerogel particles, and mixing with a cross-linkable polydimethylsiloxane (PDMS), and then casting the mixture onto the support member 46 by use of a mold. It is not necessary that all of the paraffin oil be absorbed into the porous material (i.e. there can be more paraffin oil than can be absorbed by the porous material). Thereafter, the PDMS is cured. After curing, the PDMS coated rod is extracted from the mold. In embodiments, the outer layer 51 is prepared by mixing a cross-linkable polydimethylsiloxane (PDMS) and then casting the mixture onto the inner layer 50 by use of a mold. In embodiments, the liquid cross-linkable PDMS is prepared from a two-component system, namely, a base agent and a curing agent. In further embodiments, the base agent and curing agent are present in a weight ratio of from about 50:1 to about 2:1, or from about 20:1 to about 5:1 in both the inner layer 50 and the outer layer 51. In embodiments, the weight ratio of the elastomeric material to the porous material 48 and functional material of the inner layer 50 is at a weight ratio of from about 20:1 to about 1:5, or from about 10:1 to about 1:5 or from about 3:1 to about 1:3.

The delivery member 38 may be presented in a roll or have other configurations such as a web. The thickness of the inner layer 50 and the outer layer 51 may be varied, for example, the inner layer 50 from about 1 mm to about 30 mm, or from about or from about 2 mm to about 20 mm or form about 3 mm to about 10 mm. The thickness of the outer layer 51 is from about 0.1 microns to about 1 mm, or from about 0.2 microns to about 0.9 mm or from about 0.3microns to about 0.7 mm. The delivery member 38 may have a surface pattern comprising indentations or protrusions that have a shape selected from the group consisting of circles, rods, ovals, squares, triangles, polygons, and mixtures thereof.

The description below describes embodiments of photoconductors

The Overcoat Layer

Other layers of the imaging member may include, for example, an optional overcoat layer 32. The optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the likes. The overcoat layers may further include a particulate additive such as metal oxides including aluminum oxide and silica, or low surface energy polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing a substituent capable of self cross-linking or reacting with the polymer resin to form a cured composition. Specific examples of charge transport components suitable for overcoat layer comprise the tertiary arylamine with a general formula of

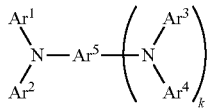

wherein $Ar^1$, $Ar^2$, $Ar^3$, and $Ar^4$ are the same or different and each independently represents an aryl group having about 4 to about 10 carbon atoms, or from about 5 to about 10 carbons, or from about 4 to about 10 carbons, such as phenyl, biphenyl and the like, $Ar^5$ represents aromatic hydrocarbon group having about 4 to about 10 carbon atoms, or from about 5 to about 10 carbons or from about 6 to about 10 carbons such as phenyl, biphenyl or the like, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be a single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate 10 is not soluble in any of the solvents used in each coating layer solution, is optically transparent or semi-transparent, and is thermally stable up to a high temperature of about 150 ° C. A substrate 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

The Hole Blocking Layer

After deposition of the electrically conductive ground plane layer, the undercoat layer14 (hole blocking layer) may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane.

General embodiments of the undercoat layer 14 may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of between about 0.05:100 to about 0.5:100 for the hole blocking layer material and solvent is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/ vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer 20 comprises a single layer of the same composition. As such, the charge transport layer 20 will be discussed specifically in terms of a single layer, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The charge transport layer 20 is normally transparent in a wavelength region in which the electrophotographic imaging member is to be used when exposure is affected there to ensure that most of the incident radiation is utilized by the underlying charge generation layer 18. The charge transport layer 20 should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive ground plane 12, image wise exposure or erasure may be accomplished through the substrate 10 with all light passing through the back side of the substrate. In this case, the materials of the charge transport layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer 20, which charge transport layer 20 generally is of a thickness of from about 5 to about 75 micrometers, and more specifically, of a thickness of from about 15 to about 40 micrometers. Examples of charge transport components are aryl amines.

Examples of the binder materials selected for the charge transport layers include components, such as those described in U.S. Pat. No. 3,121,006, the disclosure of which is totally incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer 20 should be an insulator to the extent that the electrostatic charge placed on the hole transport layer is not conducted in the absence of illumination at a rate sufficient to prevent formation and retention of an electrostatic latent image thereon. The charge transport layer 20 is substantially nonabsorbing to visible light or radiation in the region of intended use, but is electrically "active" in that it allows the injection of photogenerated holes from the photoconductive layer, that is the charge generation layer 18,and allows these holes to be transported through itself to selectively discharge a surface charge on the surface of the active layer.

In addition, in the present embodiments using a belt configuration, the charge transport layer 20 may consist of a single pass charge transport layer 20 or a dual pass charge transport layer 20 (or dual layer charge transport layer) with the same or different transport molecule ratios. In these embodiments, the dual layer charge transport layer 20 has a total thickness of from about 10 μm to about 40 μm. In other embodiments, each layer of the dual layer charge transport layer 20 may have an individual thickness of from 2 μm to about 20 μm. Moreover, the charge transport layer 20 may be configured such that it is used as a top layer of the photoreceptor to inhibit crystallization at the interface of the charge transport layer 20 and the overcoat layer. In another embodiment, the charge transport layer 20 may be configured such that it is used as a first pass charge transport layer 20 to inhibit microcrystallization occurring at the interface between the first pass and second pass layers.

The Adhesive Layer

An optional separate adhesive interface layer may be provided in certain configurations, such as for example, in flexible web configurations. In the embodiment illustrated in FIG. 1, the interface layer would be situated between the hole blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generation layer 18 to enhance adhesion bonding to provide linkage. In yet other embodiments, the adhesive interface layer is entirely omitted.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip 19 to avoid an electrically conductive ground strip 19 having an excessively irregular outer surface. An average particle size of less than about 10 micrometers generally avoids excessive protrusion of the electrically conductive particles at the outer surface of the dried ground strip 19 and ensures relatively uniform dispersion of the particles throughout the matrix of the dried ground strip 19. The concentration of the conductive particles to be used in the ground strip 19 depends on factors such as the conductivity of the specific conductive particles utilized.

The ground strip 19 may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating 1 provides flatness and/or abrasion resistance.

Anti-curl back coating 1 may be formed at the back side of the substrate 10, opposite to the imaging layers. The anti-curl back coating 1 may comprise a film forming resin binder and an adhesion promoter additive. The resin binder may be the same resins as the resin binders of the charge transport layer 20 discussed above. Examples of film forming resins include polyacrylate, polystyrene, bisphenol polycarbonate, poly(4, 4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating 1 is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

A double-layer composite delivery roller 38 (FIG. 5) typically was prepared having two layers of an elastomeric matrix 47 cast around a support member (metal mandrel) 46. The inner layer 50 was composed of a paraffin, aerogel, and PDMS and the outer layer 51 is composed of only PDMS, or a paraffin-impregnated PDMS at a lower PDMS/paraffin ratio than the inner layer 50. The inner layer 50 was prepared by first absorbing paraffin into the aerogel, then incorporation into the pre-cured PDMS polymer matrix. The mixture (PDMS/paraffin oil/aerogel) was cast onto the mandrel 46 using a cylindrical mould, followed by curing. After curing, the PDMS/paraffin/aerogel roller was extracted from the mould. The outer layer 51 was prepared by curing the liquid, cross-linkable PDMS around the inner PDMS/paraffin/aerogel inner layer 50 using a larger cylindrical mould in both length and diameter. PDMS was prepared by from a commercially available, two-component system—a base and a curing agent.

Figure 7:
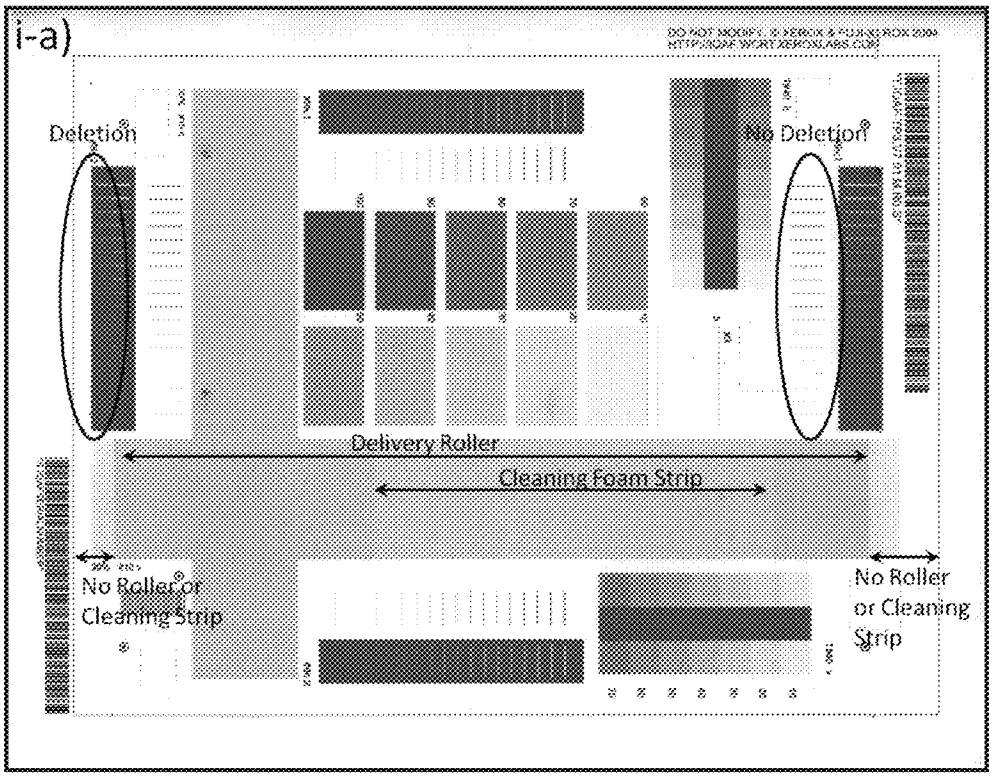
FIG. 7 is a print test after 2000 prints demonstrating A-zone deletion results of prints made with the system according to embodiments described herein.
Figure 8:
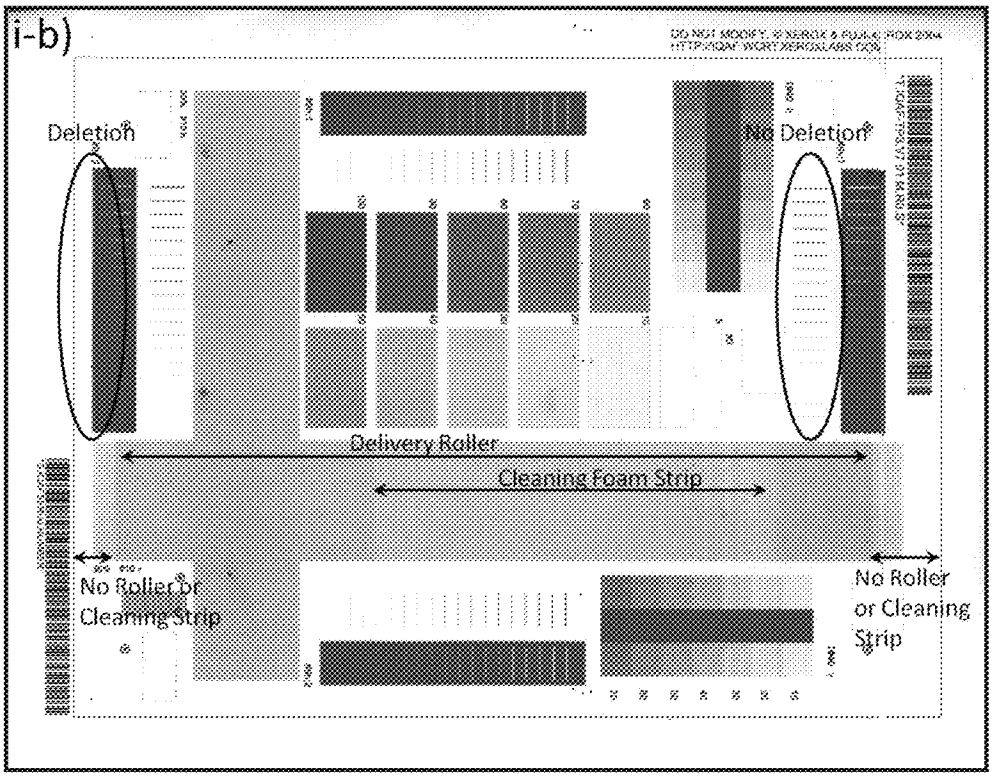
FIG. 8 is a print test after 5000 prints demonstrating A-zone deletion results of prints made with the system according to embodiments described herein.
Figure 9:
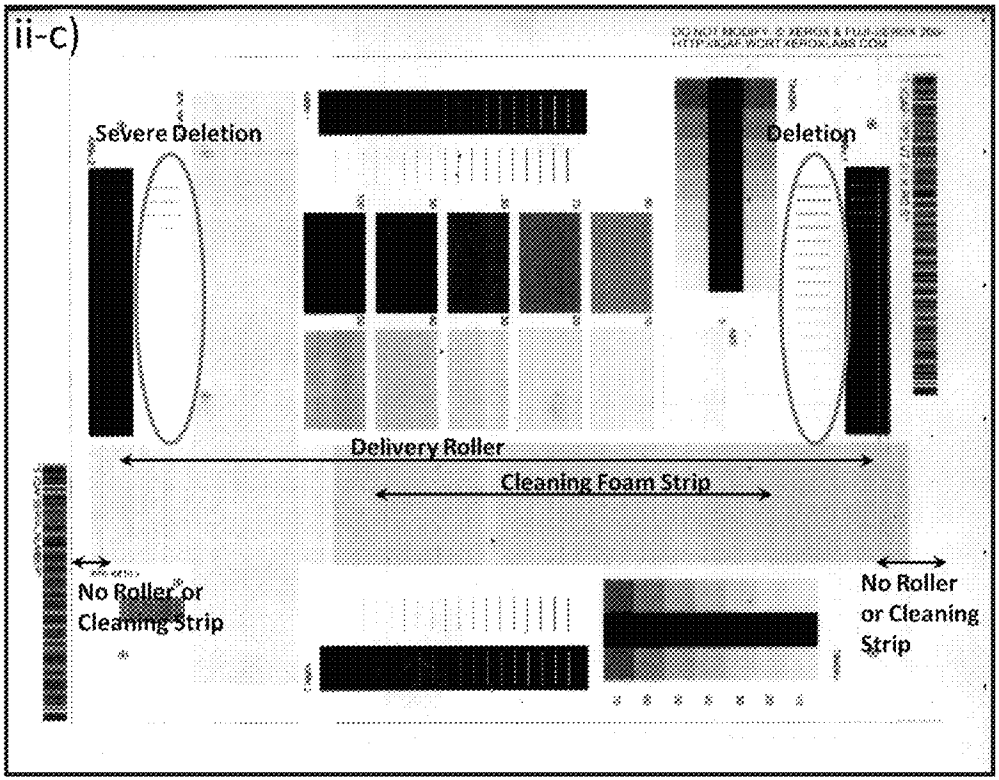
FIG. 9 is a print test after 2000 prints demonstrating A-zone deletion results of prints made with a control system.

To compare image quality with and without paraffin, a double-layer PDMS:paraffin delivery roller that spanned only a portion of the length of the P/R was used. A cleaning foam strip was added to a portion of the BCR housing to determine its influence on cleaning accumulated additives on the BCR during printing. This configuration generated i) a portion of the image with paraffin, ii) a portion with paraffin and additional cleaning capability, and iii) a control region on the image without paraffin or the cleaning strip. Print tests were completed in A-zone using a Work Centre 7435 machine. The double layer roller used to generate the images in FIG. 7 and FIG. 8 included an inner layer with a PDMS/paraffin ratio of 1:1.5 with 10% aerogel with respect to the paraffin, and an outer layer with a PDMS/paraffin ratio of 20:1 (i.e. 1:0.05). FIG. 7 shows the images of prints after 2000 prints and FIG. 8 shows the images after 5000 prints. As a comparison, a single layer roller with a PDMS/paraffin ratio of 20:1 was also run using the same photoreceptor drum (FIG. 9) and shows the images after 2000 prints.

The images in FIGS. 7 and 8 do not show any deletion in regions where the photoreceptor was in contact with the double layer roller indicating that the roller delivered sufficient paraffin for 5000 prints (17.5 kcycles). The streaking visible in the images is caused by toner trapped on the cleaning foam. In comparison, the single layer roller (FIG. 9) did not prevent A-Zone deletion after only 2000 prints (7000 cycles), (as indicated by the severe deletion across the entire print) (FIG. 9), which indicates that this roller did not supply sufficient quantities of paraffin to the P/R. These experiments prove that paraffin is effectively diffused from the inner layer to the outer layer to be delivered to the surface of the photoreceptor. Double layer rollers with the same inner layer composition (PDMS/paraffin ratio of 1:1.5 with 10 weight percent aerogel with respect to the paraffin) and an outer layer composed only of PDMS showed similar characteristics. Despite the outer layer not initially containing any paraffin oil, paraffin was still delivered to the photoreceptor, which was reflected in the image quality of the prints.

The resulting composition from paraffin absorbed in aerogel and subsequently incorporated into PDMS pre-polymer and cured acts like a saturated sponge. When pressure is applied to the elastomeric composite material, paraffin is easily released. When the applied pressure is removed, paraffin is reabsorbed into the elastomeric composite matrix. This feature prevents the passive leaking of paraffin from the matrix as is seen when paraffin is simply dispersed in PDMS.

Absorption of paraffin oil into silica aerogel and subsequent incorporation of the mixture into the PDMS matrix has increased the loading capacity of the roller from 2:1 PDMS/paraffin to 1:2 PDMS/paraffin (i.e. from 33% paraffin loading to 67% paraffin loading). A doubling of the paraffin capacity should, at minimum, double the lifetime of the roller.

A double layer design comprising a roller with an inner layer composition of aerogel, paraffin oil, and PDMS, and an outer layer composition of PDMS only, is still capable of dispensing an adequate amount of paraffin oil to the surface of the P/R to: i) sufficiently reduce torque, and ii) maintain acceptable image quality.

The double layer controls the passive loss of paraffin oil from highly loaded rollers and leads to more efficient use of the functional material. Controlling the loss of paraffin oil increases the sustainability of the paraffin oil supply thereby increasing the lifetime of the roller. Furthermore, the consumption rate of paraffin using a double layer roller is lower than a single layer roller thereby increasing the lifetime of the photoreceptors.

The aerogel provides structural support to the roller. In a roller without aerogel, the paraffin oil is confined in pores within the elastomer that are generated during the curing process. As paraffin is consumed, the pockets could collapse and the roller could lose its structural integrity. The aerogel confers rigidity to the roller that would prevent the pores from collapsing as paraffin is consumed.

Print tests (5 kprints, 12.5 kcycles) successfully completed in A-zone using a double-layer composite roller with a low wear OCL P/R indicated that sufficient paraffin was delivered; the tests resulted in good images with no deletions, and no motor faults indicating that torque was not an issue.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A delivery member for use in an image forming apparatus comprising:

a support member, and a first layer comprising an elastomeric matrix, a porous material and a functional material dispersed therein, the first layer disposed on the support member.

2. The delivery member according to claim 1, wherein the elastomeric matrix comprises a material selected from the group consisting of polysiloxane, polyalkylsiloxane, polyurethane, polyester, polyfluorosilioxanes, polyolefin, fluoroelastomer, synthetic rubber, natural rubber, and mixtures thereof.

3. The delivery member according to claim 1, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

4. The delivery member according to claim 1, wherein the functional material comprises paraffin.

5. The delivery member of claim 1, wherein the porous material comprises a mesoporous or macroporous material having a porosity of from about 50 percent to about 99.9 percent.

6. The delivery member of claim 1, wherein the porous material is selected from the group consisting of aerogel particles, ceramic particles, polymers, foam, cellulose and glass.

7. The delivery member of claim 1, wherein the porous material comprises aerogel particles selected from the group consisting of silica, carbon, alumina, titania and zirconia.

8. The delivery member of claim 1, wherein the porous material and functional material comprise about 50 weight percent to about 90 weight percent of the first layer.

9. The delivery member according to claim 1, wherein the first layer comprises a thickness of from about 1 mm to about 30 mm.

10. The delivery member according to claim 1, further comprising a second layer disposed on the first layer wherein the functional material can diffuse from the first layer through the second layer.

11. The delivery member according to claim 10, and wherein the second layer comprises a thickness of from about 0.1 μm to about 1 mm.

12. The delivery member according to claim 10, wherein the second layer comprises a polymer selected from the group consisting of polysiloxane, polyurethane, polyester, polyfluorosilioxanes, polyolefin, fluoroelastomer, synthetic rubber, natural rubber, and mixtures thereof.

13. The delivery member according to claim 10, wherein the second layer comprises pores having a size of from about less than about 1 μm.

14. A delivery member for use in an image forming apparatus comprising:

a support member;

an inner layer comprising an elastomeric matrix, aerogel particles and paraffin dispersed therein, the inner layer disposed on the support member wherein the inner layer comprises a weight ratio of elastomeric matrix to aerogel particles and paraffin is from about 20:1 to about 1:5; and an outer layer disposed on the inner layer wherein the outer layer comprises pores having a size of from about less than about 1 μm and wherein the outer layer comprises a thickness of from about 0.1 μm to about 1 mm.

15. The delivery member according to claim 14, wherein the outer layer comprises a polymer selected from the group consisting of polysiloxane, polyurethane, polyester, polyfluorosilioxanes, polyolefin, fluoroelastomer, synthetic rubber, natural rubber, and mixtures thereof.

16. The delivery member of claim 14, wherein the aerogel particles comprise a porosity of from about 50 percent to about 99.9 percent.

17. The delivery member of claim 14, wherein the aerogel particles and paraffin comprise about 50 weight percent to about 90 weight percent of the inner layer.

18. The delivery member according to claim 14, wherein the inner layer comprises a thickness of from about 1 mm to about 30 mm.

19. An image forming apparatus comprising:

a) an imaging member having a charge retentive surface for developing an electrostatic latent image thereon, wherein the imaging member comprises:

a substrate, and a photoconductive member disposed on the substrate;

b) a charging unit for applying an electrostatic charge on the imaging member to a predetermined electric potential; and c) a delivery member disposed in contact with the surface of the imaging member or a surface of the charging unit, wherein the delivery member comprises:

(i) a support member, (ii) an inner layer comprising an elastomeric matrix, aerogel particles and a functional material dispersed therein, the inner layer disposed on the support member; and (iii) an outer layer disposed on the inner layer.

20. The image forming apparatus according to claim 19, wherein the functional material comprises paraffin, the aerogel particles comprise silica aerogel and the elastomeric matrix comprises a cross-linked polydimethylsiloxane (PDMS).

* * * * *